United States Patent [19]

LaPorta, Jr., Phil

[11] 4,338,685

[45] Jul. 13, 1982

[54] CERVICAL COLLAR

[76] Inventor: LaPorta, Jr., Phil, 1111 N. Glenstone, Springfield, Mo. 65802

[21] Appl. No.: 155,552

[22] Filed: Jun. 2, 1980

[51] Int. Cl.[3] ..... A41D 13/00

[52] U.S. Cl. ..... 2/2

[58] Field of Search ..... 2/2, 425; 128/76 R, 128/163, 380

[56] References Cited

U.S. PATENT DOCUMENTS

| | | | |
|---|---|---|---|
| 3,017,639 | 1/1962 | Foley | 2/2 |
| 3,134,106 | 5/1964 | Shaffer et al. | 2/2 |
| 3,497,872 | 3/1970 | Mitchell | 2/2 |
| 3,514,784 | 6/1970 | McDavid | 2/2 |
| 3,657,739 | 4/1972 | Holmes | 2/2 |
| 3,765,029 | 10/1973 | Germain | 2/2 |
| 3,855,631 | 12/1974 | Ettinger | 2/2 |
| 3,900,896 | 8/1975 | Ackerman | 2/425 |
| 3,981,027 | 9/1976 | Anderson | 2/2 |
| 4,135,252 | 1/1979 | Latina | 2/2 |
| 4,158,242 | 6/1979 | Mitchell | 2/2 |
| 4,219,193 | 8/1980 | Newman | 128/76 R |

*Primary Examiner*—Louis Rimrodt

*Attorney, Agent, or Firm*—Kokjer, Kircher, Bradley, Wharton, Bowman & Johnson

[57] ABSTRACT

A cervical collar attaches to a shoulder pad harness to reduce the size of the neck opening and to elevate the neck opening. The collar includes a pair of arched cantilevers which are connected by a small plate and padded around the edges defining the neck opening. The helmet contacts the edge of the neck opening in the collar to limit flexing of the neck such that excessive lateral cervical flexion and hyperextension of the neck are prevented.

10 Claims, 4 Drawing Figures

CERVICAL COLLAR

BACKGROUND AND SUMMARY OF THE INVENTION

This invention relates in general to protective gear and more particularly to a cervical collar for attachment to athletic shoulder pads.

Of all the various types of injuries that occur in contact sports such as football, injuries to the neck are perhaps the most serious. Hyperextension of the neck to the rear can cause permanent damage to the spinal cord and can result in paraplegia, quadriplegia and other forms of paralysis, as well as severe injury to other parts of the neck and upper back area such as muscles and ligaments. If the neck is bent excessively to one side, the nerves in the brachial plexus can be stretched to cause what is commonly known as a "pinched nerve". In severe cases, excessive lateral cervical flexion can cause permanent and irreparable damage to the nerves of the brachial plexus. Undue flexing of the neck at an angle to the rear and to one side can result in equally serious damage to the cervical spine, brachial plexus and adjacent areas of the neck and upper back.

Even though it is recognized that neck injuries present a serious problem in contact sports, very little progress has been made in developing protective athletic equipment for the neck. The various types of protective collars that have been proposed have not been successful in significantly reducing either the frequency or the severity of neck injuries. Most cervical collars are intended for use principally in guarding against further damage to an already injured neck and are not designed to protect against injury in the first instance. Moreover, existing protective collars such as the Thomas collar are typically so bulky and thick that they impair the mobility of the player wearing them. In addition, the collars that have been proposed in the past, as exemplified by U.S. Pat. No. 3,514,784 to McDavid, have complicated shapes and compound curvatures which make them difficult and expensive to produce. Protective collars of this type rely on complete coverage of the neck area for their effectiveness, and the resulting constriction of the neck severely limits its normal movement and thus hampers the performance of the player. Collars such as that of McDavid are so high that they present a hazard to other players who may injure their hands or arms upon contact with the collar. Existing cervical collars are further characterized by lack of effective cooperation with standard shoulder pad harnesses.

It is the primary object of the present invention to provide an improved cervical collar for protecting the neck against hyperextension and excessive lateral cervical flexion.

Another object of the invention is to provide a cervical collar which is well adapted either for attachment to a standard shoulder pad harness as add-on equipment or for incorporation into the shoulder pad harness as original equipment.

Still another object of the invention is to provide a cervical collar that avoids inhibiting the neck in its normal movement. It is an important feature of the invention in this regard that the collar serves as a restrictive device which limits undue flexing of the neck without hampering ordinary neck movement. Consequently, the collar performs its protective function without reducing the effectiveness of the player wearing it.

A further object of the invention is to provide a cervical collar of the character described which reduces the size of the neck opening of the shoulder pads and raises the neck opening such that contact between the helmet and the edge of the neck opening precludes excessive bending of the neck. The collar utilizes the reduced size of the neck opening to perform its protective function, rather than relying upon the height or cushioning ability of the collar as is commonly done in the prior art.

An additional object of the invention is to provide a cervical collar that is simple and economical to construct and easy to install on various types of shoulder harnesses.

Yet another object of the invention is to provide a cervical collar that is lightweight and has a low profile to avoid presenting an injury hazard to other players.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
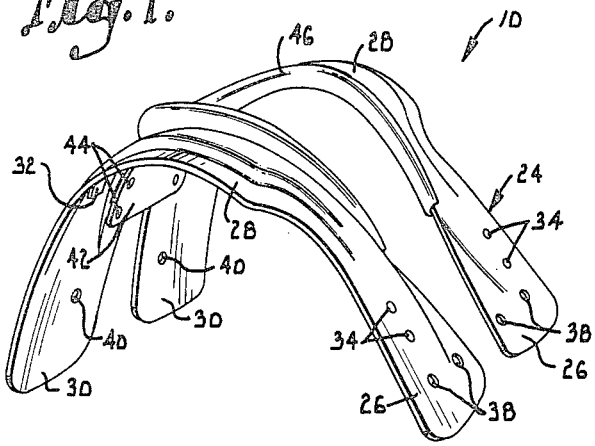
FIG. 1 is a perspective view of a protective cervical collar constructed according to a preferred embodiment of the present invention.

Refering now to the drawing in detail, the numeral 10 generally designates a protective cervical collar constructed in accordance with the present invention. The cervical collar 10 is attached to a standard shoulder pad harness of the type shown in FIGS. 2 and 3. The shoulder pad harness includes a pair of chest plates 12 which merge at their upper ends into a pair of shoulder pads 14 that extend over the shoulder area of the player wearing the harness. The shoulder pads 14 merge into back plates 16 which cover the upper back of the player. Straps (not shown) extend beneath the armpits to connect the chest plates 12 with the back plates 16, while the chest plates may be tied together by a cord or lace. The shoulder pads 14 have flaps 18 and shoulder caps 20 which cover the shoulder and upper arm area. A neck opening 22 is formed in the harness for receiving the neck.

Turning to the details of the cervical collar 10, a pair of arch shaped members which may be referred to as catilevers 24 are contoured to extend along the chest plates 12, shoulder pads 14 and back plates 16 at locations on opposite sides of the neck opening 22. The cantilevers 24 are substantially mirror images of one another and are formed of a hard, rigid plastic substance in the preferred form of the invention. Each cantilever 24 has a front plate portion 26 which extends along chest plate 12, a curved bight portion 28 which extends along the shoulder pad 14, and a rear plate portion 30 which extends along back plate 16. The inside or opposing edges of cantilevers 24 are curved in general conformity with the curvature of the edge of the neck opening 22 of the shoulder pad harness, although the cantilever edges are closer together, as will be explained more fully.

Figure 4:
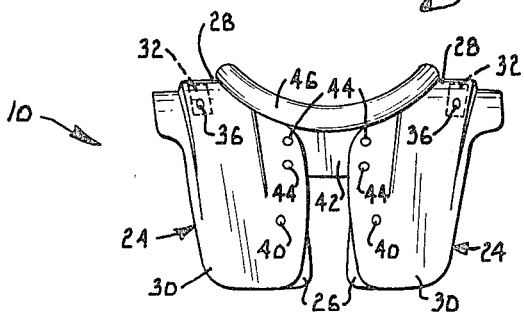
FIG. 4 is a rear elevational view of the cervical collar.

A rigid metal brace 32 is secured to extend along the underside of each cantilever 24. Braces 32 are curved, arch shaped members which strengthen and stiffen the cantilevers. Plate portions 24 are riveted at 34 to the front ends of the braces. Another rivet 36 (FIG. 4) secures the back end of each brace 32 to the back plate portion 30. The lower end of each front plate portion 26 has a pair of openings 38 to permit riveting of the collar to the shoulder pad harness. A single opening 40 is formed in each back plate 30 so that it can be riveted to the back plate 16 of the shoulder pad harness.

Cantilevers 24 are connected by a plastic plate 42 which extends between the back plate portions 30 of the cervical collar and is riveted thereto at 44. Plate 42 is preferably formed from a hard plastic substance of the same type used to construct the cantilevers. The curved front edge of plate 42 essentially forms a continuation of the inside edges of the cantilevers 24 around the neck opening of the collar. A curved pad 46 extends continuously along the inside edges of cantilevers 24 and the forward edge of plate 42 to cushion the neck opening of the cervical collar. The pad 46 is preferably formed from rubber which is covered by a vinyl strip that is stitched to cantilevers 24 and to plate 42. The cervical collar 10 is open at the front, plate portions 26 of the cantilevers being spaced apart from one another.

The cervical collar 10 is attached to the shoulder harness by rivets or in any other suitable manner. The preformed holes 38 and 40 are suitable for receiving rivets 48 and 50, respectively, which may be used to secure the front plates 26 to chest plates 12 and back plates 30 to the back plates 16 of the harness. The spacing between the opposing inside edges of cantilevers 24 is such that the edges project inwardly beyond the corresponding edges of the neck opening 22 of the harness. Similarly, the front edge of plate 42 projects forwardly beyond the back edge of opening 22. In addition, the edges of cantilevers 24 and plate 42 are elevated with respect to the corresponding edges of the neck opening 22, and the neck opening provided by the collar is thus elevated with respect to neck opening 22. Consequently, collar 10 serves to reduce the size of the neck opening and to elevate it slightly. In a form of the invention which has achieved favorable results, the collar reduces the side to side dimension of the neck opening by two to four inches and raises it by about $\frac{3}{4}$ inch.

Figure 2:
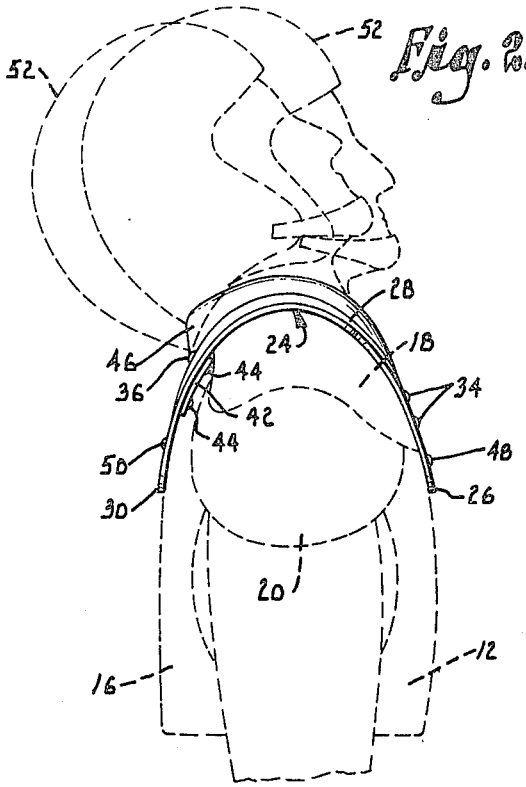
FIG. 2 is a side elevational view showing the cervical collar attached to a shoulder pad harness worn by a football player.

The reduction in size and elevation of the neck opening restricts backward movement of the neck and also lateral flexing of the neck, as well as a combination of backward and sideward bending. As shown in FIG. 2, when cervical collar 10 is attached to the shoulder pad harness, the back portion of the helmet 52 of the player contacts pad 46 at the edge of plate 42 to limit bending of the neck to the rear. Without collar 10, the neck can flex backward to the rearmost position shown in FIG. 2, while the collar limits flexing of the neck to the more forward position. Collar 10 thus prevents hyperextension of the neck to the rear. Without the collar, the neck can bend at least 57 degrees from vertical without restriction, while the collar limits the bending to approximately 50 degrees from vertical, as measured by a goniometer in accordance with the procedures set forth in the book Joint Motion—Method of Measuring and Recording, published in accordance with the American Academy of Orthopedic Surgeons. Such limiting of the backward flexing of the neck results in significantly reduced neck injuries because it prevents hyperextension caused by blows to the head tending to bend the neck backward.

Figure 3:
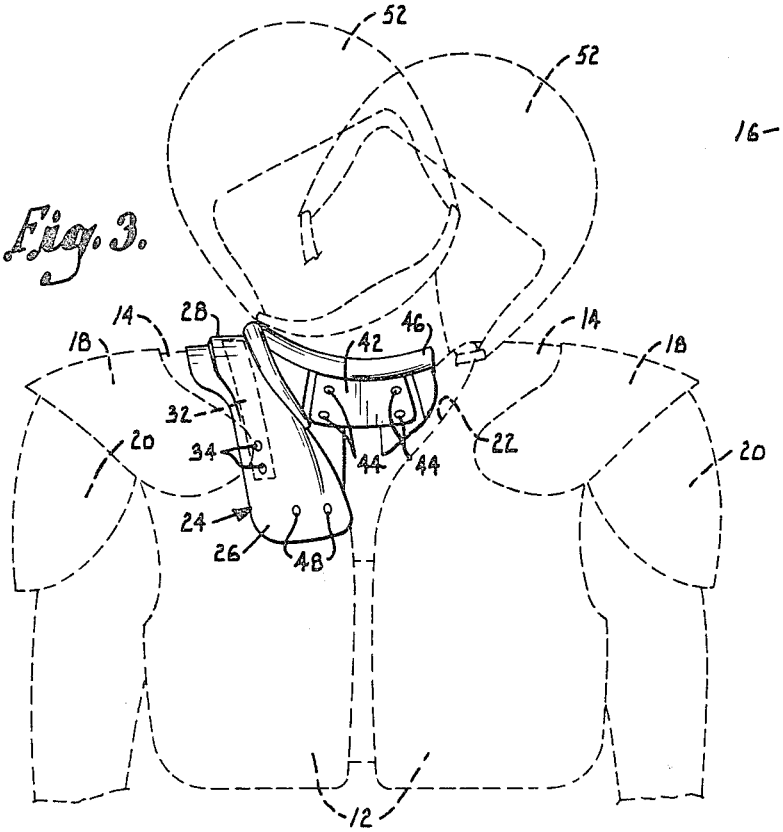
FIG. 3 is a front elevational view showing the cervical collar attached to the shoulder pad harness, with a portion of the collar broken away for illustrative purposes.

Collar 10 also prevents excessive lateral cervical flexion, as best shown in FIG. 3. When a blow to the side of the head occurs tending to bend the neck to one side, the earpiece of helmet 52 contacts pad 46 adjacent the inside edge of one of the cantilevers 24 to limit the flexing of the neck to the position shown in broken lines on the left hand side of FIG. 3. In this position, the neck is bent approximately 60 degrees from vertical which is not far enough to cause a significant possibility of a "pinched nerve" or other serious damage to the neck area. Without collar 10, the neck can flex without restriction at least to the position indicated in broken lines on the right side of FIG. 3, wherein it is flexed approximately 84 degrees from vertical. This additional lateral cervical flexion is sufficient to cause a possibility of serious injury to the brachial plexus of the neck.

By way of example, favorable results have been achieved with cantilevers 24 each approximately $7\frac{1}{2}$ inches in height from base to apex with a distance of approximately 11 inches presented between the bottom edges of front plates 26 and back plates 30. The cantilevers may be spaced apart by approximately 3 inches at the front. Plate 42 can be approximately 5 inches long and $3\frac{1}{2}$ inches wide. It is to be understood that the collar may be provided with other dimensions, depending primarily upon the size of the shoulder pads and the player wearing them. It should also be understood that the cervical collar 10 can be incorporated in the shoulder pad harness as original equipment rather than added on to an existing pair of shoulder pads as explained herein. The collar serves well also in preventing further injury to a previously injured neck. In addition, excessive bending of the neck to the rear and partly to one side is prevented by the collar due to the reduction in size of the neck opening and its elevation to a position where the helmet can contact its edge.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A protective collar device for a user wearing a helmet and an athletic shoulder pad harness having a neck opening for receiving the neck, said device comprising:

a pair of spaced apart arch members constructed of a rigid material and adapted for rigid attachment to the harness with inside edge portions of the arch members extending inwardly into the neck opening adjacently above the surface of the harness surrounding the opening; and a rigid connecting member rigid with and extending between said arch members with a front edge portion of said connecting member located to project forwardly into the neck opening adjacently above the surface of the harness surrounding the opening, said edge portions of the arch members and connecting member cooperating to reduce the size of the neck opening and to elevate the neck opening to a position wherein the helmet contacts said edge portions of the arch members and connecting member to limit bending of the neck to the sides and to the rear.

2. A device as set forth in claim 1, including a curved pad mounted in extension along the inside edge portions of said arch members and the front edge portion of said connecting member.

3. A device as set forth in claim 1, wherein the shoulder pad harness includes chest plates and back plates interconnected by shoulder pads, said arch members having curvatures to extend along the chest plates, shoulder pads and back plates when attached to the shoulder harness.

4. A device as set forth in claim 3, including means for attaching each arch member to one of the chest plates and one of the back plates, thereby mounting the collar device to the harness.

5. A device as set forth in claim 1, including a rigid arch shaped brace secured to each arch member.

6. A device as set forth in claim 5, wherein said braces are secured in extension along undersides of the respective arch members.

7. In a shoulder pad harness having chest plates, back plates, shoulder pads and a neck opening for receiving the neck of a user wearing a helmet, the improvement comprising:

a first rigid arch member rigidly and immovably secured to the harness on one side of the neck opening and having an inside edge portion extending inwardly into the neck opening;

a second rigid arch member rigidly and immovably secured to the harness on the opposite side of the neck opening and having an inside edge portion extending inwardly into the neck opening in opposition to the edge portion of said first arch member; and a rigid connecting member rigid with and extending between said arch members along the back of the neck opening and having a front edge portion extending substantially between the edge portions of said arch members and projecting forwardly into the neck opening, said edge portions of the arch members and connecting members cooperating to reduce the size of the neck opening and to elevate the neck opening to a position wherein the helmet contacts said edge portions of the arch members and connecting member to limit bending of the neck to the sides and to the rear.

8. The improvement set forth in claim 7, wherein said arch members are curved in extension along outer surfaces of the chest plates, shoulder pads and back plates of the harness, said edge portions of the arch members and connecting member being located immediately above underlying surfaces of the harness to elevate the neck opening of the harness.

9. The improvement set forth in claim 7, including a rigid arch shaped brace secured between the harness and each arch member.

10. The improvement set forth in claim 7, including a curved pad extending along the edge portions of said arch members and connecting member.

* * * * *